US007647772B2

(12) United States Patent
Sausse et al.

(10) Patent No.: US 7,647,772 B2
(45) Date of Patent: Jan. 19, 2010

(54) SURFACE TREATMENT FOR VARIABLE GEOMETRY TURBINE

(75) Inventors: Lorrain Sausse, Charmes (FR); Daniel Frank, Charmes (FR); Clemence Filou, Epinal (FR); Gary Agnew, Dommartin les Remiremont (FR); Tanguy Domange, Bruyeres (FR)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/376,476

(22) Filed: Mar. 14, 2006

(65) Prior Publication Data

US 2007/0214788 A1 Sep. 20, 2007

(51) Int. Cl.
*F02D 23/00* (2006.01)

(52) U.S. Cl. ..... 60/602; 415/200

(58) Field of Classification Search ..... 415/200, 415/159–165
See application file for complete search history.

(56) References Cited

U.S. PATENT DOCUMENTS 4,302,149 A * 11/1981 Smale ..... 415/134
6,682,299 B2 * 1/2004 Bowen et al. ..... 415/160
2005/0011192 A1 * 1/2005 Ohishi ..... 60/602

* cited by examiner

*Primary Examiner*—Thomas Denion
*Assistant Examiner*—Douglas J. Duff
(74) *Attorney, Agent, or Firm*—Brian Pangrle

(57) ABSTRACT

An exemplary vane fronting surface for a variable geometry turbine includes a white layer that comprises nitrides. Such a layer may be formed using gas nitriding. As described, trials demonstrate that such nitriding reduces friction between a vane fronting surface and vanes of a variable geometry turbine. Consequently, nitriding can enhance longevity and controllability of a variable geometry turbine.

13 Claims, 7 Drawing Sheets

EXEMPLARY TURBOCHARGER

SURFACE TREATMENT FOR VARIABLE GEOMETRY TURBINE

TECHNICAL FIELD

Subject matter disclosed herein relates generally to methods, devices, systems, etc., for turbines and turbochargers and more specifically to surface treatments for variable geometry mechanisms associated with turbines and turbochargers.

BACKGROUND

During operation of a variable geometry or variable nozzle turbine (VNT), a pressure differential can be generated between a command side and a vane body side of a variable geometry mechanism. Such a pressure differential can act on various vane components and force a vane component against another component, increase force between a vane and another component and/or increase force between vane components. Consequently, an increase in pressure differential can affect vane controllability. For example, a pressure differential can force a vane post against an opposing vane side surface (e.g., turbine casing wall) and thereby increase friction and force required to initiate vane rotation and/or increase friction and force required during vane rotation. Recent trends in turbocharger technology, including higher turbine inlet pressure, higher expansion ratio of vanes and larger vane axis diameters (e.g., higher loading, potentially larger contact areas and therefore possibly more resistance), will tend to exacerbate such problems. Therefore, a need exists for technology that addresses friction problems associated with variable geometry turbines. As discussed herein, a treatment is applied to a surface that at least partially bounds or defines a space for a vane or plurality of vanes. The treatment acts to reduce friction, which can enhance controllability of a variable geometry turbine and promote longevity.

SUMMARY

An exemplary vane fronting surface for a variable geometry turbine includes a white layer that comprises nitrides. Such a layer may be formed using gas nitriding. As described, trials demonstrate that such nitriding reduces friction between a vane fronting surface and vanes of a variable geometry turbine. Consequently, nitriding can enhance longevity and controllability of a variable geometry turbine. Various components, operational conditions, treatment techniques, etc., are discussed below.

BRIEF DESCRIPTION OF THE DRAWINGS

A more complete understanding of the various exemplary methods, devices, systems, etc., described herein, and equivalents thereof, may be had by reference to the following detailed description when taken in conjunction with the accompanying drawings wherein.

DETAILED DESCRIPTION

Various exemplary devices, systems, methods, etc., disclosed herein address issues related to operation of a variable geometry turbine. For example, as described in more detail below, various exemplary devices, systems, methods, etc., address vane friction, wear, control, etc. The description presents a prior art turbocharger and a prior art vane arrangement followed by an exemplary treatment technique to treat a turbocharger component and data from trials of treated and untreated components.

Figure 1:
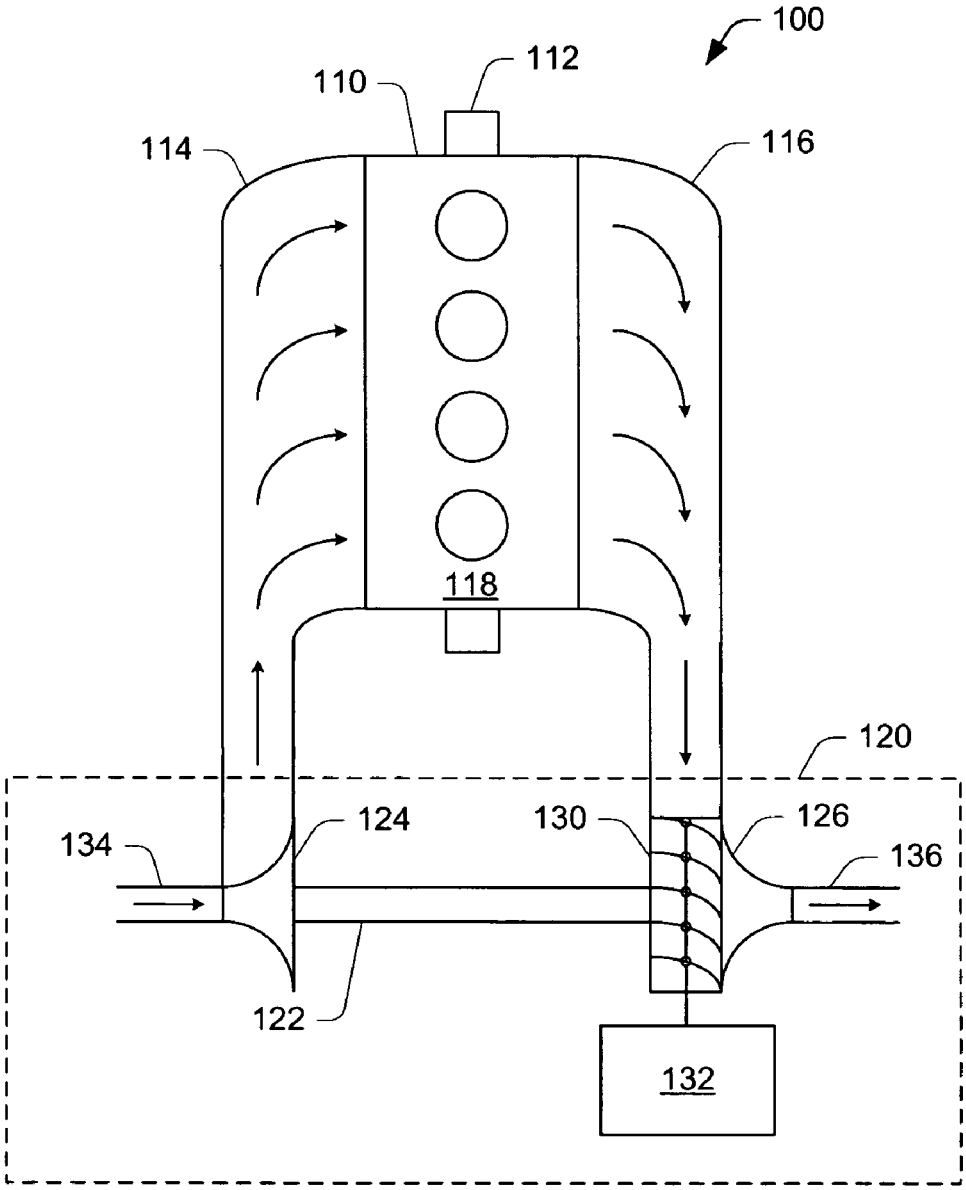
Fig.1 (Prior Art)
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a variable geometry unit 130, a variable geometry controller 132 and an exhaust outlet 136. The variable geometry unit 130 optionally has features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine in order to optimize turbine power with the required load. Movement of vanes towards a closed position typically directs exhaust flow more tangentially to the turbine, which, in turn, imparts more energy to the turbine and, consequently, increases compressor boost. Conversely, movement of vanes towards an open position typically directs exhaust flow in more radially to the turbine, which, in turn, reduces energy to the turbine and, consequently, decreases compressor boost. Closing vanes also restrict the passage there through which creates an increased pressure differential across the turbine, which in turn imparts more energy on the turbine. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies.

Figure 2:
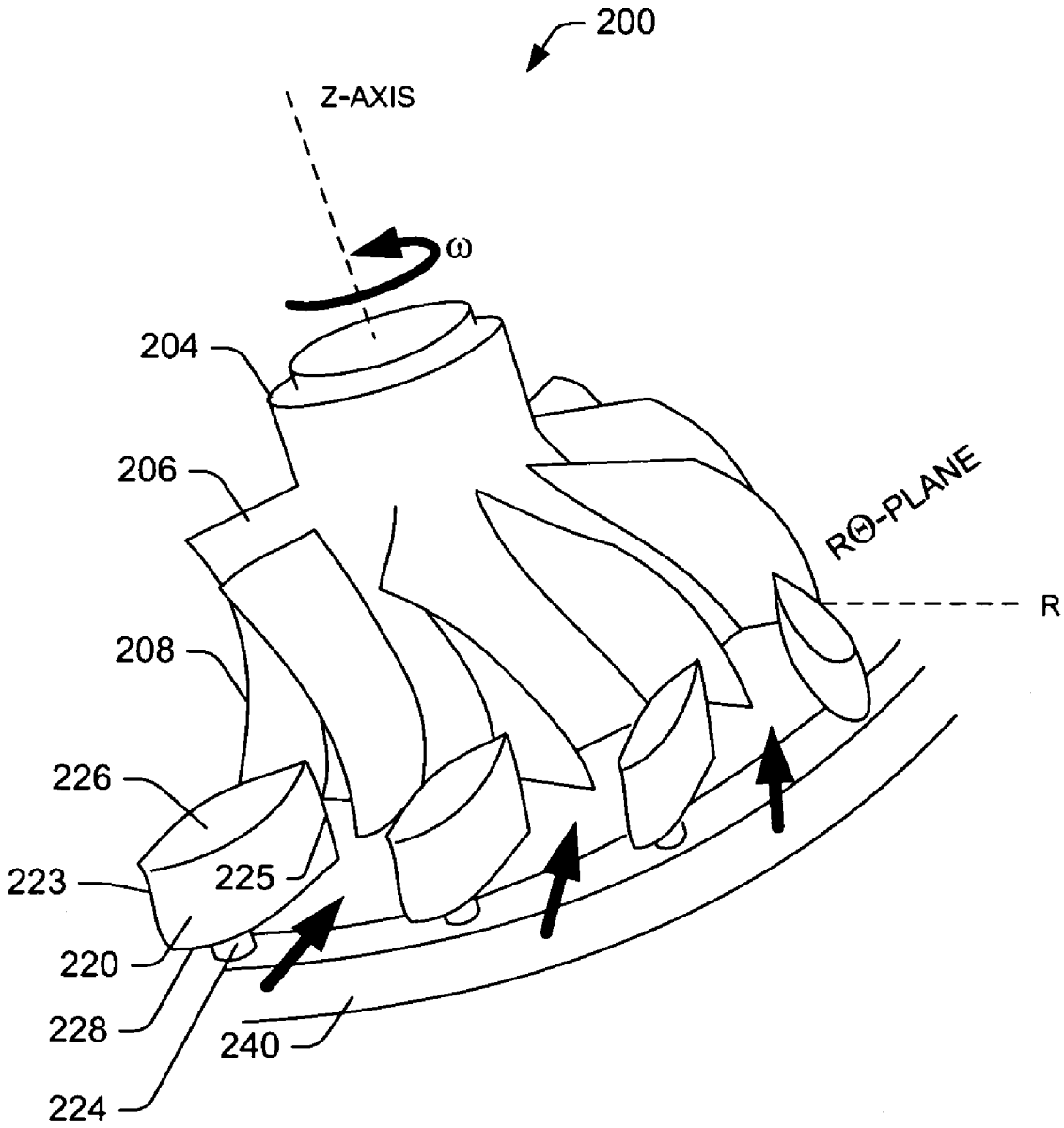
Fig.2 (Prior Art)
FIG. 2 is an approximate perspective view of a turbine and vanes, which may be associated with a variable geometry mechanism.

FIG. 2 shows an approximate perspective view a system 200 having a turbine wheel 204 and vanes 220 associated with a variable geometry mechanism. The turbine wheel 204 is configured for counter-clockwise rotation (at an angular velocity ω) about the z-axis. Of course, an exemplary system may include an exemplary turbine wheel that rotates clockwise. The turbine wheel 204 includes a plurality of blades 206 that extend primarily in a radial direction outward from the z-axis. Each of the blades 206 has an outer edge 208 wherein any point thereon can be defined in an r, Θ, z coordinate system (i.e., a cylindrical coordinate system).

In this example, the vanes 220 are positioned on axles or posts 224, which are set in a vane base 240, which may be part of a variable geometry mechanism. In this system, the individual posts 224 are aligned substantially parallel with the z-axis of the turbine wheel 204. Each individual vane 220 has an upper surface 226. While individual posts 224 are shown as not extending beyond the upper surface 226, in other examples, the posts may be flush with the upper surface 224 or extend above the upper surface 226. With respect to adjustment of a vane, a variable geometry mechanism can provide for rotatable adjustment of a vane 220 to alter exhaust flow to the blades 206 of the turbine wheel 204. In general, an adjustment adjusts an entire vane and typically all of the vanes wherein adjustment of any vane also changes the shape of the flow space between adjacent vanes. Arrows indicate general direction of exhaust flow from a vane inlet end 223 to a vane outlet end 225. As mentioned above, adjustments toward "open" direct exhaust flow more radially to the turbine wheel 204; whereas, adjustments toward "closed" direct exhaust flow more tangentially to the turbine wheel 204.

Figure 3:
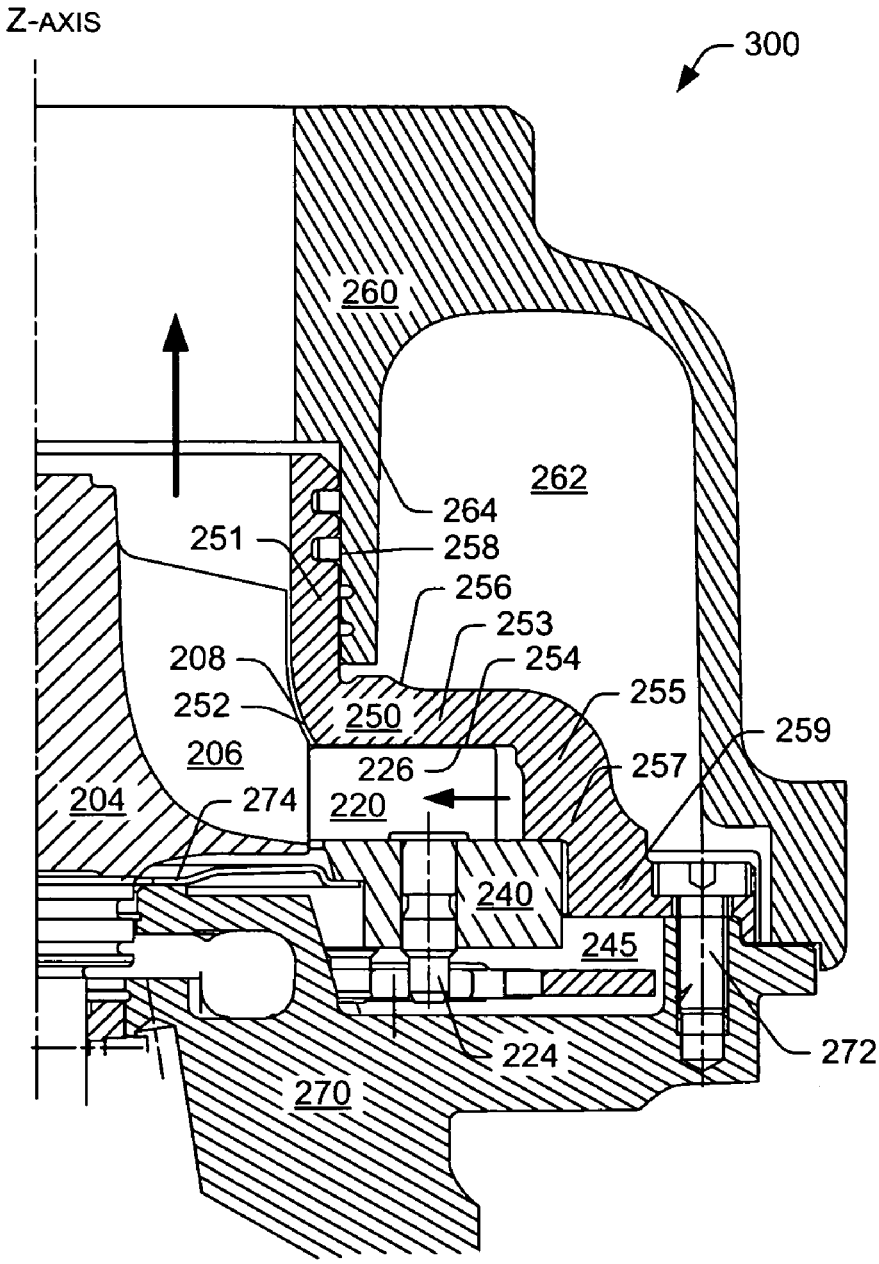
Fig.3 (Prior Art)
FIG. 3 is a cross-sectional view of an exemplary variable geometry turbine that includes an exemplary insert and an exemplary vane.

FIG. 3 shows a cross-sectional view of an exemplary variable geometry turbine 300. The turbine 300 may be part of a turbocharger assembly such as the turbocharger 120 of FIG. 1. The turbine 300 includes a turbine wheel 204 having an axis of rotation along the z-axis. The turbine wheel 204 includes one or more blades 206 wherein each blade has an outer edge 208. A vane 220 is positioned at a radius from the z-axis and is part of a variable geometry mechanism. The vane 220 includes a post 224 that passes through a vane base 240. In this example, the vane 220 includes a single post 224, which facilitates rotation of the vane 220. A command side space 245 may become pressurized by exhaust gas during operation. Flow velocity, indicated by arrows, can cause a decrease in pressure in a vane side space and thereby generate a pressure differential between the vane side space and the command side space 245. Again, such a pressure differential can act to apply force to the post 224, the vane 220 and/or other components. In a conventional variable geometry turbine, such force may inhibit control of various variable geometry components.

The turbine 300 includes an insert 250 that includes, from the top down (i.e., along the z-axis): a substantially cylindrical or tubular portion 251; a substantially planar, annular portion 253; one or more extensions 255; a leg or step portion 257; and a base portion 259. The portion 253 includes a vane side surface 254 and a volute side surface 256. Depending on operational conditions and component condition, the upper surface 226 of the vane 220 can contact the vane side surface 254 of the insert 250. Such contact can affect controllability of the vane 220. For example, friction between these two surfaces can occur during sharp transient phases of operation of an engine when the vane actuator (mechanical, electrical, pneumatic, hydraulic, etc.) attempts to rotate vanes to reach a desired vane position as required by an engine control unit. Such friction may reduce response time of the vanes, cause wear of the vanes, cause wear of the vane fronting surface (e.g., surface 254), cause wear of the actuator or related components, etc. More specifically, as discussed below, such friction can result in scratches, pits or other defects. Such surface damage can increase of actuation effort and shorten longevity. Again, exemplary techniques described herein can reduce friction forces between a vane and a vane fronting surface.

In the example of FIG. 3, a housing 260 includes a volute side surface 264 that, in combination with one or more other components (e.g., the insert 250) forms a volute 262 for flow of exhaust gas from one or more cylinders of an engine to, predominantly, the inlet side of nozzles formed, for example, by adjacent vanes. In this particular cross-section, an extension portion 255 of the insert 250 extends to a step portion 257 and on to a base portion 259 that extends to meet a lower component 270 (e.g., a center housing, etc.). Other cross-sections lack such an extension portion or such a base portion to thereby provide for flow from the volute 262 to one or more vanes 220 (see arrow for approximate direction of flow from volute 262 and FIG. 4 for a bottom view of insert 250).

In this particular example, the insert 250 includes vane side surface 254 that extends to or proximate to the outer edge 208 of the turbine wheel blade 206. The tubular portion 251 extends axially upward (i.e., in the direction of exhaust flow leaving the turbine) from this juncture as the vane side surface 254 of the insert 250 transitions to a shroud surface 252 adjacent a portion of blade edge 208. The volute side surface 256 of the insert 250 transitions to a seal surface 258.

The insert 250 may form a kind of cartridge with various components of a variable geometry mechanism. Such components of a variable geometry mechanism may include the vane base 240 (e.g., a nozzle or unison ring) as well as other components. The leg or step portion 257 may act to receive and clamp the vane base 240 against another component such as an annular disc member 274 supported on the lower component 270 (e.g., a center housing, etc.). In the example of FIG. 3, an attachment mechanism 272 allows for attachment of the insert 250 to the lower component 270; the insert 250 and the lower component 270 thereby form a kind of stable shell for protecting movable elements of the variable geometry mechanism. A plurality of attachment mechanisms 272 (e.g., bolts, etc.) optionally serve as the only mechanisms for coupling the variable nozzle unit (e.g., vane base, vanes, etc.) to the lower component 270.

The insert 250 may allow for mechanical and/or thermal decoupling of the exhaust housing 260 and variable geometry components. In turn, the variable geometry components may experience less deformation, sticking or binding of vanes, failure, etc. Again; in the example of FIG. 3, the exhaust housing 260 couples to the lower component 270 without contacting the exemplary insert 250, for example, a clearance exists between the base portion 259 and the housing 260 and a clearance exists between the tubular portion surface 258 and the housing 260 (e.g., optionally spaced with a ring). As such, in this example, the insert 250 does not contact, or is in very limited contact with, the exhaust housing 260. In another example, some contact may occur between the housing 260 and a portion of insert 250. In this latter example, the housing 260 may include a leg step or other feature that acts to clamp the insert 250 and an attachment mechanism(s), for the housing 260 and the lower component 270, may act to secure the insert 250 in conjunction with such clamping. In yet another example, the lower component 270 includes an inner recess at the periphery for engagement of an extension of an insert, which may alleviate the need for the attachment mechanism 272.

Figure 4:
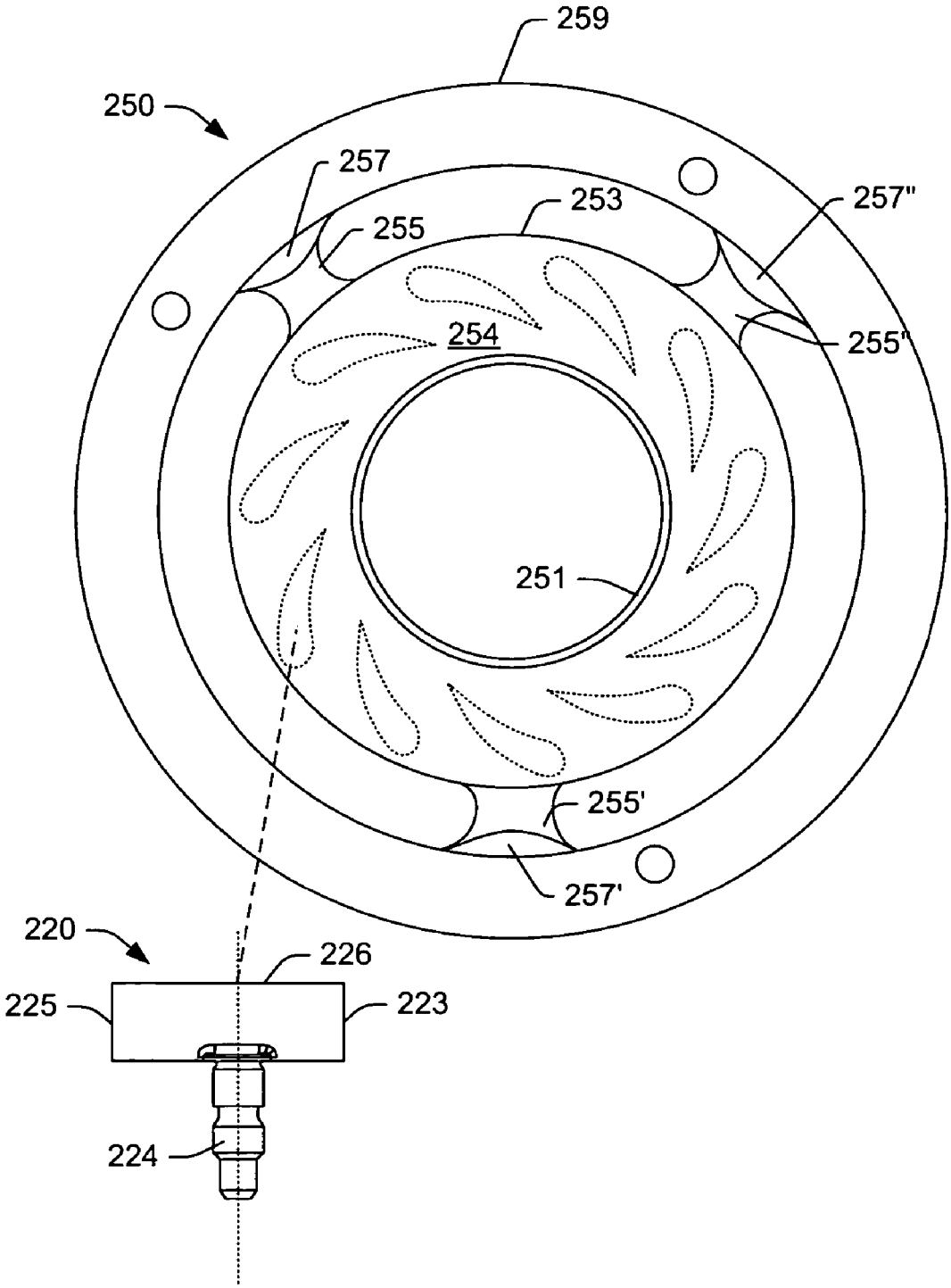
Fig. 4 (Prior Art)
FIG. 4 is a bottom view of an insert and a side view of a vane.

While an insert having a particular configuration is shown in FIG. 3, in general, a component of a turbine (or body) may have a surface that fronts one or more vanes. For example, a turbine housing may include an integral surface such as the vane fronting surface 254. In such an example, the turbine housing may include features of the turbine housing 260 and the insert 250 as a single component (e.g., molded, cast, welded, etc.). Exemplary techniques described herein may be used to treat such a surface FIG. 4 shows a bottom view of the insert 250 and a side view of a vane 220. In this example, three extensions 255, 255', 255" transition to respective step portions 257, 257', 257", which transition to the base portion 259 of the insert 250 to the substantially annular portion 253 having the surface 254. Dashed lines on the insert 250 indicate areas where contact may occur between the upper surface 226 of a vane 220 and the surface 254. As a vane pivots about its post axis, the contact area generally enlarges; thus, the dashed lines indicate areas corresponding to a particular vane position.

Figure 5:
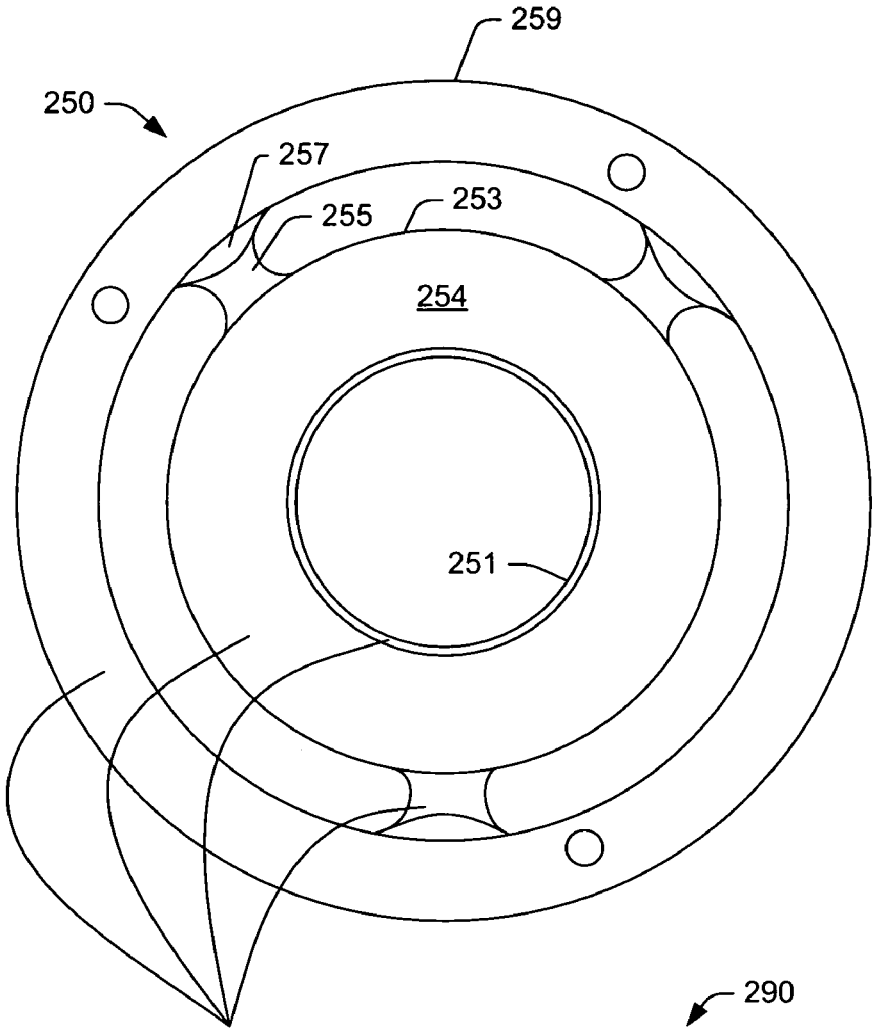
FIG. 5 is a bottom view of an insert and a micrograph of a nitrided surface.
Figure 5:
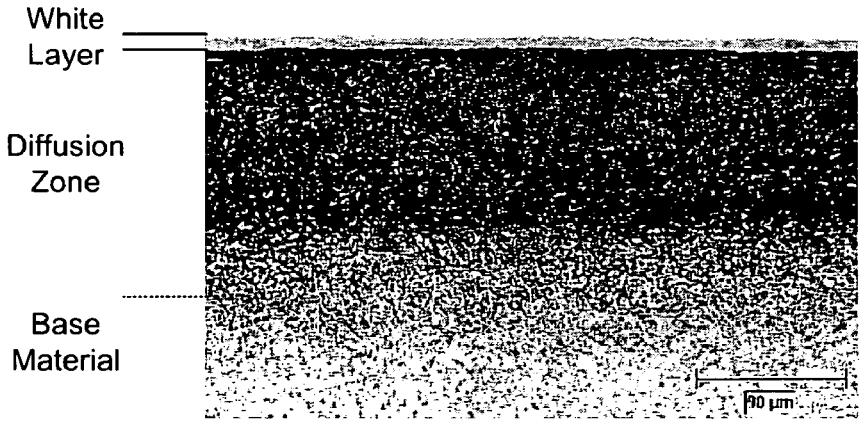

FIG. 5 shows a micrograph of a material treated with an exemplary treatment technique 290 that exposes the material to nitrogen to form nitrides. More specifically, such a nitriding technique involves diffusion of atomic (nascent) nitrogen into a material to thereby alter at least the surface of the material. Nitriding techniques include but are not limited to (a) salt bath (liquid) nitriding, where the source of nitrogen (and also carbon) is in the form of a molten salt; (b) gas nitriding, which may use a gas such as ammonia ($NH_3$) as the nitrogen source; and (c) plasma nitriding, which provides nitrogen in the form of plasma. Hardening is enhanced when the treated material (e.g., a ferrous alloy such as steel) contains strong nitride forming elements such as aluminum, chromium, vanadium, tungsten, and molybdenum. Materials that can be nitrided include, but are not limited to, aluminum-containing low-alloy steels 7140 (Nitralloy G, 135M, N, EZ); medium-carbon, chromium-containing low-alloy steels of the 4100, 4300, 5100, 6100, 8600, 8700, and 9800 series; hot-work die steels containing 5% chromium such as H11, H12, and H13; low-carbon, chromium-containing low-alloy steels of the 3300, 8600 and 9300 series; air-hardening tool steels such as A-2, A-6, D-2, D-3 and S-7; high-speed tool steels such as M-2 and M-4; nitronic stainless steels such as 30, 40,50 and 60; ferritic and martensitic stainless steels of the 400 and 500 series; asustenitic stainless steels of the 200 and 300 series; precipitation-hardening stainless steels such as 13-8 PH, 15-5 PH, 17-4 PH, 17-7 PH, A-286, AM350 and AM355.

Gas nitriding of steel typically involves exposing the steel to ammonia at a temperature between about 495° C. and about 565° C. (about 925° F. and about 1050° F.). Diffusion of nitrogen into the steel depends on nitrogen concentration, temperature and time. These parameters can be controlled to achieve a precise concentration of atomic nitrogen in a surface layer of a material. A material surface exposed to a nitriding medium will generally form two distinct layers: an outer or compound layer and an inner diffusion layer or zone (between the outer layer and the bulk material). The outside layer is sometimes called a white layer and its thickness generally falls between about zero (on the order of nanometers) and about 25 μm. Of course, given a material's thickness, concentration of nitrogen source, temperature, time, etc., it is possible to form a diffusion layer that extends through the entire thickness of a material.

The micrograph 290 of FIG. 5 is of a stainless steel turbine component treated with a gas nitriding technique that used ammonia as a nitrogen source. More specifically, in this example, the component is an insert such as the insert 250. Treatment of the surface 254 of the insert 250 causes an increase in hardness that leads to less penetration (or print) of the vane. For example, the treatment may increase the hardness of the surface 254 such that the hardness of the surface 254 exceeds the hardness of a surface of the vanes (e.g., the fronted vane surface 226). The treatment of the surface 254 also leads to better wear properties. In addition, the change in the chemical and micro-structural nature of the surface 254 reduces the affinity between the surface's base material and the vane material (generally steel). This helps to reduce adhesive wear and micro-welding between a vane and the surface 254, which also leads to less surface damage. Yet further, for the particular example shown, the nitrided surface 254 can withstand exhaust gas temperatures up to about 860° C. (about 1580° F.).

As described herein, a vane fronting surface of a variable geometry turbine is nitrided. This may be accomplished by nitriding an entire component, for example, by nitriding the entire insert 250. Alternatively, only a portion or portions of a component may be nitrided. Further, multiple components may be nitrided. For example, where a vane may front more than one surface, then each of the fronting surfaces may be nitrided.

Figure 6:
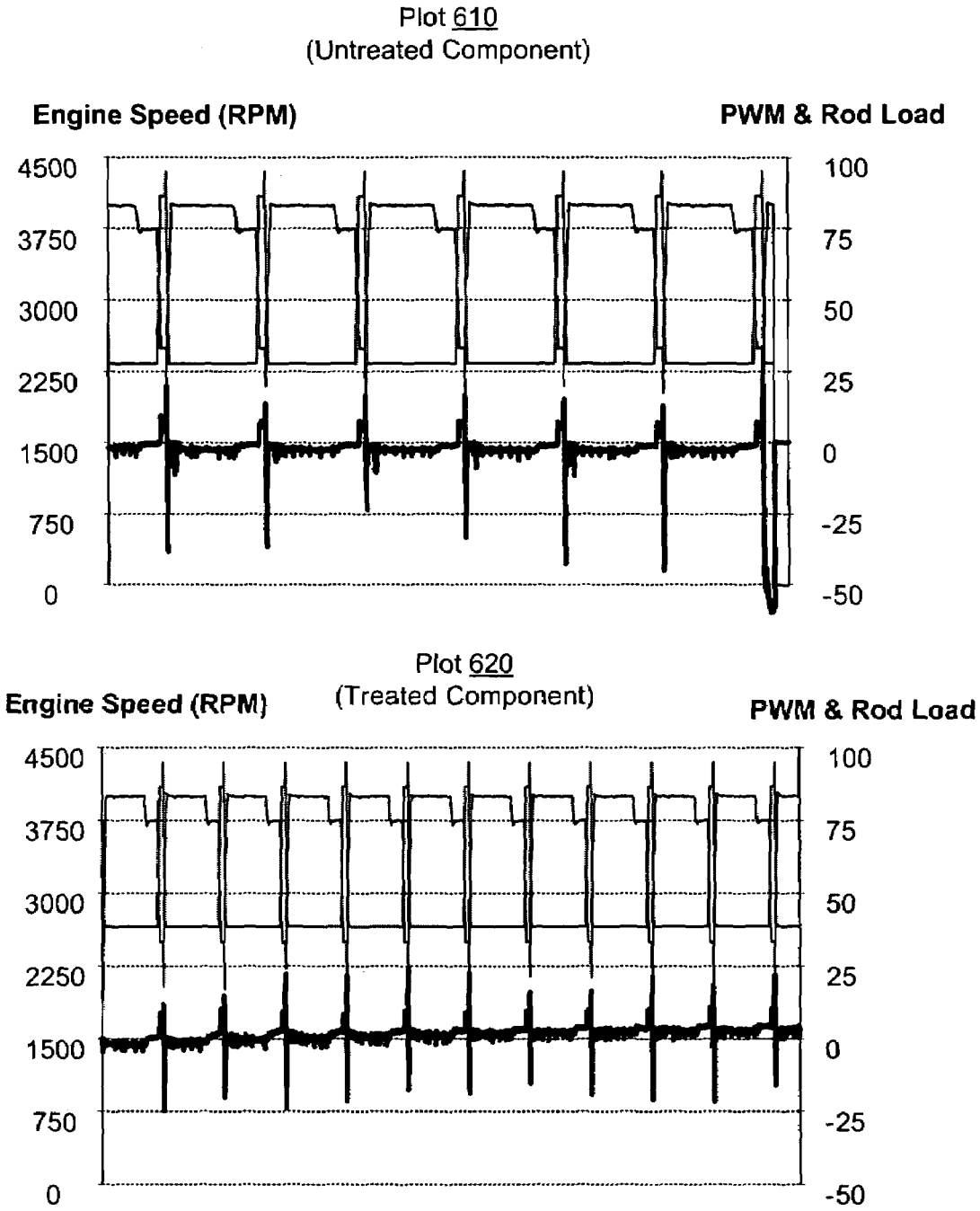
FIG. 6 is a series of plots of trial data for an untreated component and a treated component of a variable geometry turbine.

As already mentioned, a surface treatment can enhance controllability of a variable geometry mechanism. Trials were performed on a turbocharged engine (see, e.g., the turbocharged engine of FIG. 1) where the turbocharger included a variable geometry turbine with, in one set of trials, an untreated insert and, in another set of trials, a treated (nitrided) insert where these inserts included a surface that fronted a plurality of vanes of the variable geometry turbine. Some data from these trials are plotted in the plots 610, 620 of FIG. 6.

The plots 610, 620 show a pulse width modulation control signal (0 to 100), engine speed (RPM) and force (N) experienced by a component of a variable geometry actuator versus time. In these trials, as engine speed changed, a controller issued a pulse width modulation (PWM) control signal that instructed the actuator to change the position of the vanes of the variable geometry turbine. For the untreated insert, force experienced by the component often exceeded −25 N and approached −50 N. In contrast, for the treated insert, force experienced by the component was at most about −25 N. Thus, the treated insert reduced the amount of force required for operation of the variable geometry turbine. Of further note, hysteresis exists for the untreated insert, (negative force greater than positive force for control of vanes), however, the nitriding not only reduced maximum force required but also surprisingly reduced this hysteresis. Depending on specifics of the actuator and associated components, the reduction in hysteresis can also extend life or otherwise reduce wear or allow for more judicious selection of components.

Figure 7:
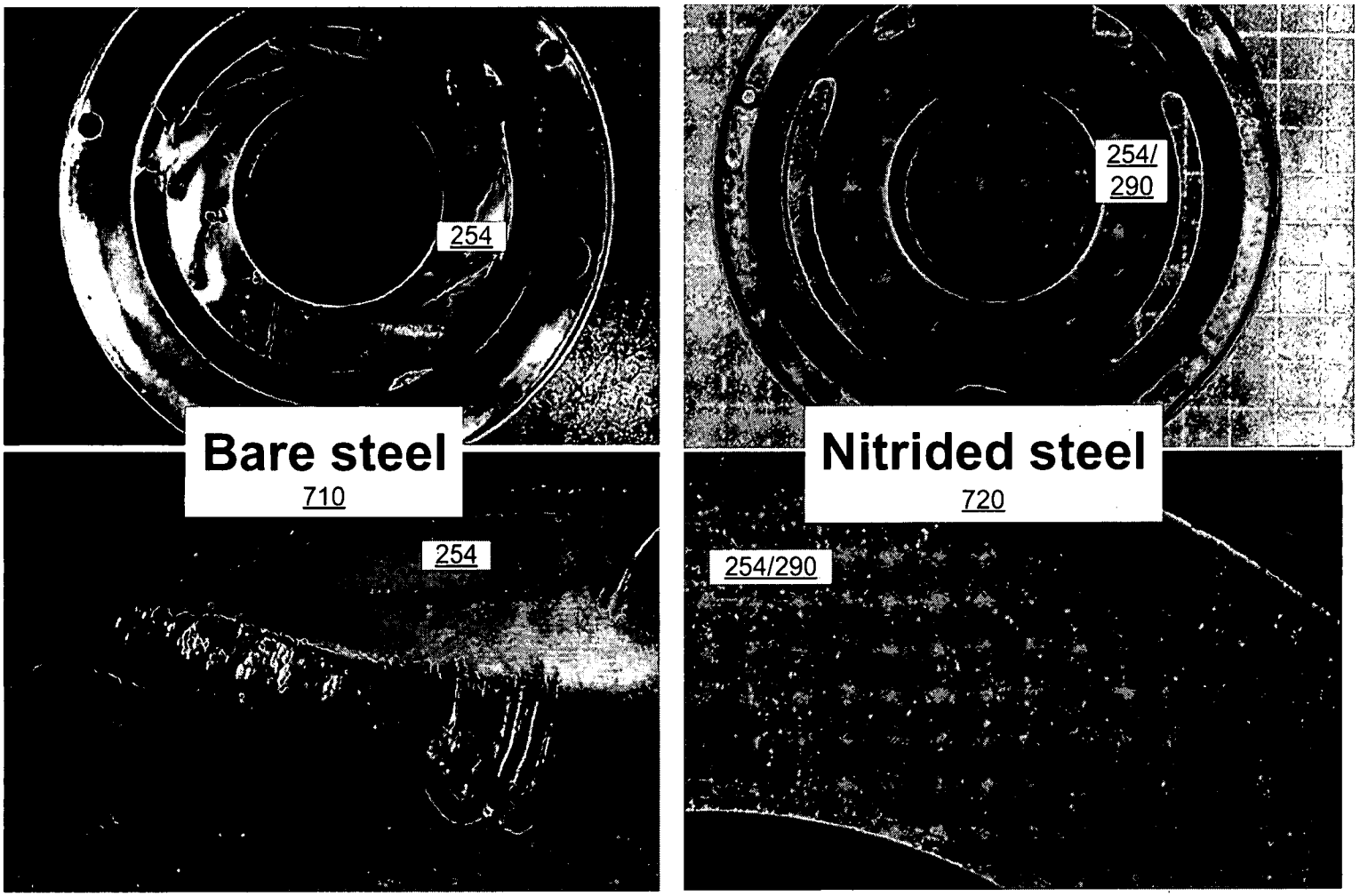
FIG. 7 is a series of photographs that correspond to the trial data of the plots of FIG. 6.

FIG. 7 shows a photographs of an untreated insert (bare steel insert) 710 and a treated insert (nitrided steel insert) 720. After use in a turbocharger, the vane fronting surface 254 of the untreated insert 710 is visibly damages by the vanes. In contrast, after use in a turbocharger, the treated vane fronting surface 254/290 of the treated insert 720 shows little visible indications of contact with the vanes.

An exemplary method for manufacturing a turbocharger (or a variable geometry turbine) includes providing a turbine housing, providing a vane base, providing a plurality of vanes for setting in the vane base, providing an insert for positioning at least partially between the turbine housing and the vane base, nitriding a surface of the insert and assembling a turbocharger (or a variable geometry turbine) using the turbine housing, the vane base, the vanes and the insert wherein the nitrided surface of the insert fronts the plurality of vanes. Additional or alternative nitriding of one or more other surfaces may occur as already described (e.g., entire insert, vane base, vanes, etc.).

Another exemplary method for manufacturing a turbocharger (or a variable geometry turbine) includes providing a turbine housing, providing a vane base, providing a plurality of vanes for setting in the vane base, providing an insert for positioning at least partially between the turbine housing and the vane base wherein the insert comprises a nitrided surface that fronts the plurality of vanes and assembling a turbocharger (or a variable geometry turbine) using the turbine housing, the vane base, the plurality of vanes and the insert. Additional or alternative nitriding of one or more other surfaces may occur as already described (e.g., entire insert, vane base, vanes, etc.).

An exemplary method for operating a variable geometry turbine includes providing a variable geometry turbine that includes a turbine housing, a plurality of vanes set in a vane base and an insert positioned at least partially between the turbine housing and the vane base wherein the insert includes a nitrided surface that fronts the plurality of vanes; actuating the vanes to rotate the vanes clockwise or counter-clockwise wherein the actuating applies a positive force to the vanes; and actuating the vanes to rotate the vanes counter-clockwise or clockwise wherein the actuating applies a negative force to the vanes and wherein the nitrided surface diminishes hyseteresis between the positive force and the negative force.

As already mentioned, exhaust gas pressure, pressure transients, control actions, etc., can push vanes towards one or more vane end fronting surfaces. An exemplary treated vane fronting surface can withstand better contact with vanes compared to an untreated vane fronting surface. In addition, an actuator for adjusting vanes may act with less force, with more accuracy, with less wear, with greater efficiency, etc., due at least in part to a treated vane fronting surface.

Although some exemplary methods, devices, systems arrangements, etc., have been illustrated in the accompanying Drawings and described in the foregoing Detailed Description, it will be understood that the exemplary embodiments disclosed are not limiting, but are capable of numerous rearrangements, modifications and substitutions without departing from the spirit set forth and defined by the following claims.

The invention claimed is:

1. A variable geometry exhaust turbine comprising:

a turbine housing;

a vane base;

a vane side space and a command side space defined in part by opposite sides of the vane base wherein a pressure differential forms between the vane side space and the command side space during operational transients;

a plurality of vanes set in the vane base wherein each vane comprises a post extending from the command side space to the vane side space, that defines a pivot axis, wherein the vane base receives each post to allow for pivoting of a vane about its pivot axis and wherein the pressure differential forms in a direction of the pivot axis; and an insert positioned at least partially between the turbine housing and the vane base wherein the insert comprises a nitrided surface that fronts the plurality of vanes, wherein contact exists between the vanes and the nitride surface due to formation of the pressure differential during operational transients, wherein the contact and the pressure differential cause vane actuation hysteresis and wherein the nitrided surface of the insert reduces friction between the vanes and the insert and reduces the vane actuation hysteresis.

2. The variable geometry turbine of claim 1 wherein each vane comprises a lower surface adjacent the vane base and an upper surface fronting the nitrided surface of the insert.

3. The variable geometry turbine of claim 1 wherein gas nitriding creates the nitrided surface.

4. The variable geometry turbine of claim 3 wherein the gas nitriding comprises providing ammonia.

5. The variable geometry turbine of claim 1 wherein the nitrided surface withstands an exhaust gas temperature of 860° C.

6. The variable geometry turbine of claim 1 wherein the nitride surface comprises a thickness of approximately 25 μm.

7. The variable geometry turbine of claim 1 wherein the nitrided surface comprises a hardness that resists pitting from contact between the nitrided surface and the vanes.

8. The variable geometry turbine of claim 1 wherein the nitrided surface comprises a hardness that exceeds the hardness of a surface of the vanes.

9. The variable geometry turbine of claim 1 wherein the nitrided surface comprises less than the entire surface of the insert.

10. The variable geometry turbine of claim 1 wherein the insert is nitrided.

11. The variable geometry turbine of claim 1 wherein each vane comprises a nitrided surface.

12. The variable geometry turbine of claim 1 wherein the vane base comprises a nitrided surface.

13. A method of manufacturing a turbocharger comprising:

providing a turbine housing;

providing a vane base wherein opposite sides of the vane base define in part a vane side space and a command side space;

providing a plurality of vanes for setting in the vane base wherein each vane comprises a post extending from the command side space to the vane side space;

providing an insert for positioning at least partially between the turbine housing and the vane base;

nitriding a surface of the insert; and assembling a turbocharger using the turbine housing, the vane base, the vanes and the insert wherein the nitrided surface of the insert fronts the plurality of vanes, wherein contact exists between the vanes and the nitride surface due to a pressure differential between the command side space and the vane side space during operational transients of the turbocharger, wherein the contact and the pressure differential cause vane actuation hysteresis, and wherein the nitrided surface reduces friction between the vanes and the insert and reduces the vane actuation hysteresis.

* * * * *